United States Patent [19]

Kishida et al.

[11] Patent Number: 4,925,500

[45] Date of Patent: May 15, 1990

[54] HIGH-STRENGTH HOT-ROLLED STEEL SHEET HAVING REMARKABLY EXCELLENT COLD WORKABILITY AND PROCESS FOR MANUFACTURING THE SAME

[75] Inventors: Koji Kishida; Osamu Akisue, both of Himeji, Japan

[73] Assignee: Nippon Steel Corporation, Tokyo, Japan

[21] Appl. No.: 320,265

[22] PCT Filed: Jun. 27, 1988

[86] PCT No.: PCT/JP88/00639

§ 371 Date: Nov. 18, 1988

§ 102(e) Date: Nov. 18, 1988

[87] PCT Pub. No.: WO88/10318

PCT Pub. Date: Dec. 29, 1988

[30] Foreign Application Priority Data

Jun. 26, 1987 [JP] Japan ..... 62-157891
Feb. 8, 1988 [JP] Japan ..... 63-25767

[51] Int. Cl.[5] ..... C22C 38/16; C21D 8/04

[52] U.S. Cl. ..... 148/12 F; 148/12 C; 148/332

[58] Field of Search ..... 148/332, 12 F, 12 C; 420/89

[56] References Cited

FOREIGN PATENT DOCUMENTS 53-79717 7/1978 Japan ..... 148/12 C
55-79827 6/1980 Japan ..... 148/12 F
61-52349 3/1986 Japan .
61-159528 7/1986 Japan .

*Primary Examiner*—Deborah Yee
*Attorney, Agent, or Firm*—Wenderoth, Lind & Ponack

[57] ABSTRACT

A heat-treatment hardenable hot-rolled steel sheet having remarkably excellent cold workability comprising 0.0005 to 0.015% of carbon, 0.05 to 0.5% of manganese, 0.001 to 0.030% of sulfur, 1.0 to 2.2% of copper, 0.100% or less of phosphorus, 1.0% or less of silicon, 0.0050% or less of nitrogen, and 0.002 to 0.10% of sol. aluminum with the balance being iron and unavoidable elements and substantially comprising a ferritic single phase structure free from occurrence of pearlite. The steel may also contain 0.01 to 0.2% titanium, 0.005 to 0.2% niobium, 0.15 to 0.45% nickel and/or 0.0001 to 0.0030% boron. The steel sheet is produced by hot-rolling the steel at a temperature above the $Ar_3$ point and coiling the hot-rolled steel strip at a temperature of, preferably, 350° C. or below. The resultant steel sheet is relatively easy to work, and its strength can be dramatically increased by heat treatment for a short period of time after working.

19 Claims, 6 Drawing Sheets

HIGH-STRENGTH HOT-ROLLED STEEL SHEET HAVING REMARKABLY EXCELLENT COLD WORKABILITY AND PROCESS FOR MANUFACTURING THE SAME

TECHNICAL FIELD

The present invention relates to a hot-rolled steel sheet for use in applications where the steel is strengthened for final use by heat treatment after working, and a process for manufacturing the same.

BACKGROUND ART

Conventional hot-rolled high-strength steel sheets for working have a carbon content of about 0.03% or more and are usually manufactured by utilizing the strengthening of the structure through quenching by making use of the carbon and further precipitation hardening through addition of solid-solution strengthening elements, such as manganese, silicon or phosphorus, and the use of carbonitrides of titanium, niobium, etc.

The workability, particularly ductility of the high strength steel sheet thus manufactured decreases with an increase in the tensile strength. Therefore, it is impossible to ensure high strength while maintaining high workability.

There exists n technique which can sufficiently meet the above-described conflicting requirements of ensuring high strength while maintaining high workability. One of the techniques considered ideal for solving the above-described problem is that the steel sheet has low strength and high workability, particularly sufficiently high ductility, during cold work deformation, while the strength of the work produced by working can be increased after the completion of the working. If this technique can be realized, it is possible to produce a final product in the form of a complicated worked part which is also strong. Examples of the technique according to this ideal include a process described in Japanese Patent Publication No. 17049/1982. This process utilizes a change in the state of copper from that of solid solution to that of precipitation. That is, in this process, the steel sheet is worked while it is in a low strength state and thereafter the worked part is heat-treated to precipitate copper, thereby increasing the strength of the worked part.

However, the technique described in Japanese Patent Publication No. 17049/1982 with respect to an increase in the strength of the steel sheet through heat treatment of copper in the form of solid solution for causing precipitation, and conditions for the heat treatment, have been well known in the art for a long time. For example, they are expressly described in "Alloys of Iron and Copper" published by McGraw-Hill Book Company, Inc., 1934.

There is an ever-increasing demand from users with respect to an increase in the characteristics of the material for a recent hot-rolled steel sheet having high workability. This is because there are an increasing demand for parts having a complicated shape requiring high work deformation and an ever-increasing need on the side of steel sheet users with respect to cost reduction through a reduction in the number of the steps of working for deformation as much as possible. Therefore, the above-described process described in Japanese Patent Publication No. 17049/1982 does not meet at all the above-described demands of the steel sheet users.

One of the recent strong demands of the steel sheet users is to increase the strength of the final product to a great extent. For example, in recent years, there is a demand for the production of a part from a steel sheet having a tensile strength as high as at least 60 kgf/mm$^2$, which part had a tensile strength of 45 kgf/mm$^2$ when produced in the prior art. This renders necessary to develop a process which enables the manufacture of a steel sheet having not only very high strength but also high workability.

Further, there is a demand for a steel sheet which exhibits very high deformation working performance during deformation working. This is attributed to the fact that since final parts having more and more complicated shapes are desired, a steel sheet meeting this requirement should be provided. Moreover, there is also a strong demand on the users' side with respect to a reduction in the number of steps of working, which makes it necessary to provide a steel sheet having very high deformation working.

A further demand on the users' side is to simplify the step of heat treatment. It is a matter of course that the parts maker intending cost reduction has a need of further increasing the productivity through the completion of the heat treatment in a short period of time.

There is no prior art process meeting the these demands of the steel sheet users with respect to a new steel sheet. The present inventors have developed a process meeting the above-described demands.

DISCLOSURE OF INVENTION

First of all, the heat-treatment hardenable hot-rolled steel sheet for working falling within the scope of the present invention will be described.

For the following reasons, the heat-treatment hardenable hot-rolled steel sheet for working according to the present invention basically comprises 0.0005 to 0.015% of carbon, 0.05 to 0.5% of manganese, 0.001 to 0.030% of sulfur, 1.0 to 2.2% of copper, 0.100% or less of phosphorus, 1.0% or less of silicon, 0.0050% or less of nitrogen, 0.002 to 0.10% of sol. aluminum, and unavoidable elements and substantially comprising a ferritic single phase free from occurrence of pearlite and, if necessary, either or both of titanium and niobium and further nickel or boron are incorporated therein.

The present inventors have made a study on a hot-rolled steel sheet containing copper and, further added thereto, various elements alone or in combination thereof and, as a result, have newly found that the increment of the strength by virtue of the precipitation of copper varies with the carbon content and a lowering in the carbon content brings about a far greater increment of the strength than that attained by the conventional precipitation of copper. FIG. 1 is a graph showing the relationship between the carbon content and the tensile strength of a steel sheet manufactured by forming an ingot of a steel comprising a basic composition composed of 0.15% of manganese, 0.02% of silicon. 0.015% of sulfur, 0.01% of phosphorus, 0.0020% of nitrogen, 0.03% of sol. aluminum, and 1.3% of copper and carbon in an amount varying in a range from 0.0015 to 0.0465%, heating the ingot to 1050° C., completing hot rolling at a temperature of the $Ar_3$ point or above to form a steel sheet having a thickness of 3.0 mm, and coiling the sheet at 300° C. In the drawing, curve (a) represents the above-described relationship in the case of a hot-rolled steel sheet coiled at 300° C., and curve (b) represents the above-described relationship in the case where the coiled hot-rolled steel sheet has been heated-treated at 600° C. for 10 min. The difference in the value between curve (a) and curve (b) is the increment of the strength attributed to the precipitation of copper. When the carbon content is 0.025% or more, the increment of the strength is about 15 kgf/mm$^2$, while when the carbon content is 0.015% or less, the increment is as high as about 20 kgf/mm$^2$ In the hot-rolled steel sheet as coiled, the tensile strength rapidly changes when the carbon content exceeds 0.015%. The reason for such a difference in the strength cannot be explained by the solid-solution strengthening of copper. According to the difference in the strength, the hot-rolled steel sheet as coiled exhibits a rapid change in the elongation as well. FIG. 2 is a graph showing the relationship between the elongation and the carbon content of the same hot-rolled steel sheet containing 1.3% of copper as that of FIG. 1. As is apparent from FIG. 2, the limitation of the carbon content to 0.015% or less ensures very high ductility.

The reason why high ductility and large increment of the strength through heat treatment can be attained when the carbon content is 0.015% or less has not been elucidated yet. However, the reason is presumed as follows. Specifically, since copper segregates in the steel, the copper content of the ferrite is different from that of the pearlite, and the pearlite has a higher copper content. For this reason, the copper present in the pearlite has a higher degree of supersaturation with respect to the equilibrium solid solubility than the copper present in the ferrite, so that copper is easily precipitated in the pearlite. Therefore, when the carbon content is high and the pearlite is present, a portion of the copper is precipitated and the steel sheet is hardened even when the steel sheet is coiled at a temperatures as low as 300° C. On the other hand, when the steel sheet has a low carbon content and comprises a ferritic single phase free from pearlite, no hardening is caused because the copper is in the form of solid solution in a supersaturated state It is presumed that the heat treatment of these hot-rolled sheets at a temperature as high as about 600° C. might bring about sufficient precipitation of copper in a supersaturated state.

Thus, in order to ensure a very large increment of the strength and very high ductility, it is necessary for the carbon content to be decreased as much as possible. The lower limit of the carbon content is 0.0005% from the viewpoint of a limit with respect to the preparation of an ingot on a commercial scale. On the other hand, when the carbon content exceeds 0.015%, the increment of the strength and the ductility are lowered and at the same time there occurs a limitation with respect to the coiling temperature in the step of hot rolling in the manufacture of a steel sheet before working. This is because the ductility of steel sheet before working is lowered due to the formation of a hardened structure. In view of the above, the carbon content should be 0.0005 to 0.015%.

The carbon content is particularly preferably 0.0005 to 0.0050% depending upon the capability of steel manufacture.

On the other hand, according to the example of the above-described Japanese Patent Publication No. 17049/1982, the carbon content is 0.04% and the steel sheet as hot rolled has an elongation of 37.9% and a tensile strength of 38.1 kg/mm$^2$. Further, the increment of the strength attained by the heat treatment at 550° C. for 1 hr is 13.9 kg/mm$^2$. With the carbon content disclosed in the above-described patent, a pearlite phase structure is present as opposed to the present invention, so that a portion of the copper is precipitated even in the stage of the sheet as hot rolled. Consequently, the ductility and the increment of the strength attained by the heat treatment are both remarkably inferior to those in the case of the present invention.

The characteristic feature with respect to an improvement in the strength after heat treatment in the present invention resides in that not only an increase in the strength of the steel sheet as a whole but also an increase in the local strength of a molded part by local heating is large. The term "local heating" used herein is intended to mean, e.g., welding, such as spot welding, arc welding and flash-butt welding, and local heating means, e.g., irradiation with high-energy beams such as laser beams or electron beams, plasma heating, high-frequency heating, burner heating, etc. FIG. 3 is a graph showing the distribution of the hardness in the cross section of a spot weld zone. As is apparent from FIG. 3, because of its low carbon content, the steel of the present invention is lower in the strength of the nugget zone than that of the comparative steel having the same strength and brings about an increase in the hardness in the heat-affected zone attributed to the precipitation of copper. FIG. 4 is a graph showing the cross tension strength of the steel of the present invention in the spot weld zone in comparison with that of the comparative steel. As is apparent from FIG. 4, the steel of the present invention has a cross tension strength far higher than that of the comparative steel, i.e., has a cross tension strength at least twice higher than that of the comparative steel in terms of the cross tension strength in such an appropriate welding current as will provide a nugget diameter of $5\sqrt{t}$ (wherein t is the thickness of the sheet). As is apparent from FIG. 3, this is attributed to an increase in the hardness in the heat-affected zone by virtue of the precipitation of copper. The steel of the present invention has a feature that an increase in the local strength can be attained even by application of heat for a very short period of time such as spot welding.

FIG. 5 is a graph showing an effect of the number of runs of laser beam radiation on the change in the hardness of a steel sheet. The laser beam radiation was conducted by making use of $CO_2$ gas laser at 10 kW under conditions of a beam size of 10×10 mm, a radiation time of 0.05 sec and a radiation interval of 6 sec. The hardness is greatly increased when the laser beam is radiated several times.

In general, in a structural material, the place where there is a fear of breakage is usually a very limited portion. Therefore, there is little need of strengthening the whole part by heat treatment. Further, it is desired that the formed article is continuously heat-treated in a short period of time from the viewpoint of productivity and cost. Therefore, the strengthening of only the place where there is a fear of breakage through heat treatment for a short period of time has a very large technical significance.

One specific example requiring the local heating is a wheel disk of an automobile. The wheel is one of the important safety parts, and the service life thereof is governed by the fatigue characteristics of the material. The places of the wheel where cracking occurs are sites where strain in the thicknesswise direction is large, such as nut seats and hats; edges of sheared holes such as decorative hole portion and bolt hole portion; and a spot weld zone between the disk and the rim. The fatigue strength in these places is important.

FIG. 6 is a graph showing the results of an investigation on the fatigue strength before and after heat treatment (600° C.×30 sec) of the steel of the present invention. As opposed to the comparative material, the steel of the present invention exhibits a high fatigue strength, particularly exhibits a very high fatigue strength after heat treatment because the heat treatment brings about an increase in the tensile strength. The application of local heating to the place where there is a fear of causing fatigue cracking enables a remarkable increase in the service life.

Phosphorus is an element effective in improving the strength and the corrosion resistance of the steel sheet. If there exists none of these needs, the phosphorus content may be 0.03% or less. On the other hand, when an improvement in the strength and the corrosion resistance is intended, it is preferred that phosphorus be added in an amount of 0.06 to 0.10%. Since deep drawing-induced brittleness of the steel sheet is caused when the phosphorus content exceeds 0.100%, the upper limit of the phosphorus content is 0.100%. As with the addition of copper, the addition of phosphorus is effective in enhancing the corrosion resistance of the steel sheet.

Silicon is usually present as an impurity in an amount of 0.03% or less. Silicon is added as an element for improving the strength of the steel sheet in an amount of 1.0% or less, preferably 0.3 to 1.0% depending upon the necessary level of the strength. When the silicon content exceeds 1.0%, the occurrence of a scale in the step of hot rolling is remarkable, which brings about the deterioration of the surface property. In view of the above, the upper limit of the silicon content is 1.0%.

It is preferred from the viewpoint of enhancing the workability of the steel sheet that the manganese and sulfur contents each be low. The upper limits of the manganese and sulfur contents are 0.5% and 0.030%, respectively, and preferably the ranges are 0.05 to 0.30% and 0.001 to 0.010%, respectively. The lower limit of the manganese content is 0.05% because when the manganese content is excessively small, a surface crack of the steel sheet is liable to occur.

In order to enhance the workability of the steel sheet, the nitrogen content is preferably low, 0.0050% or less.

Copper is in a solid solution state prior to working and is allowed to precipitate through heat treatment after working, thereby increasing the strength. FIG. 7 is a graph showing an effect of the heat treatment time (heat treatment temperature: 550° C.) of a steel comprising an extra-low carbon steel and copper added thereto, on the increment of the strength (tensile strength after heat treatment minus tensile strength as hot rolled) wherein copper is used as a parameter. In the drawing, curve (a) represents the results with respect to a copper content of 2.06%, curve (b) the results with respect to a copper content of 1.68%, curve (c) the results with respect to a copper content of 1.38%, and curve (d) the results with respect to a copper content of 0.71%. As is apparent from FIG. 7, when the copper content is less than 1.0%, no sufficient increase in the strength is attained as shown in curve (d). On the other hand, when the copper content exceeds 2.2%, the surface quality is deteriorated. In view of the above, the copper content is 1.0 to 2.2%, preferably 1.2 to 2.0%.

Aluminum is an element necessary for deoxidation. When the sol. aluminum content is less than 0.002%, no sufficient deoxidation is attained. On the other hand, excessive sol. aluminum brings about an increase in the formation of alumina, which in turn brings about an adverse effect on the surface quality of the steel. In view of the above, the upper limit of the aluminum content is 0.10%.

The addition of either or both of titanium and niobium, respectively,.in amounts of 0.01 to 0.2% and 0.005 to 0.2% causes carbon and nitrogen to be fixed by these elements, which brings about the formation of a non-aging steel sheet. When the steel sheet is a non-aging one, there occurs no lowering in the ductility accompanying the aging, which makes it possible to manufacture a steel sheet having further improved ductility.

Since titanium reacts with carbon, oxygen, nitrogen, sulfur, etc. present in the steel, the titanium content should be determined by taking into consideration the amounts of these elements. In order to attain high press workability through fixation of these elements, it is necessary that titanium be added in an amount of 0.01% or more. However, the addition in an amount exceeding 0.2% is disadvantageous from the viewpoint of cost.

Since niobium as well reacts with carbon, oxygen, nitrogen, etc., the niobium content should be determined by taking into consideration the amounts of these elements. In order to attain high press workability through fixation of these elements, it is necessary that niobium be added in an amount of 0.005% or more. However, the addition in an amount exceeding 0.2% is disadvantageous from the viewpoint of cost.

Nickel is effective in maintaining the surface of the steel sheet in a high-quality state and preventing the occurrence of hot shortness. Nickel may be added in an amount ranging from 0.15 to 0.45% depending upon the necessity.

The hot shortness of a copper-added steel occurs when a copper-enriched portion formed under a scale formed on the surface of the steel becomes liquid upon being heated above the melting point and penetrates into the austenite grain boundaries. Therefore, in order to prevent the occurrence of hot shortness in the step of hot rolling of a slab, it is ideal for the copper-enriched portion to be heated below the melting point, and it is preferred that the heating be conducted at 1080° C. or below. However, since a lowering in the heating temperature brings about an increase in the rolling load, the heating is not always conducted at a temperature of 1080° C. or below when the performance of a rolling mill is taken into account. In this case, the addition of nickel is useful. When nickel is added, nickel as well is concentrated at the copper-enriched portion, which brings about a rise in the melting point of the copper-enriched portion. This effect is small when the amount of addition of nickel is less than 0.15%, while the addition of nickel in an amount exceeding 0.45% is disadvantageous from the viewpoint of cost.

The present inventors have found that boron contributes to a remarkable lowering in the $Ar_3$ point of the steel when added in combination with copper. In the hot rolling of the steel according to the present invention, it is necessary that the rolling should be completed above the $Ar_3$ point in order to maintain the material for the steel sheet in a high quality state. In the steel of the present invention, as described above, the carbon content is 0.015% or less in order to control the precipitation of copper. Therefore, the steel of the present invention has a high $Ar_3$ point, so that the rolling termination temperature should be high. On the other hand, as described above, it is preferred from the viewpoint of maintaining the surface of the steel sheet of the present invention in a high-quality state that the heating temperature be low, which brings about a difficulty accompanying the manufacturing of the steel sheet, i.e.. with heating at a low temperature and termination of rolling at a high temperature. In view of the above, the present inventors have made a study on an effect of the addition of elements on the $Ar_3$ point of the copper-added extra-low carbon steel and, as a result, have found that the addition of boron brings about a remarkable lowering in the $Ar_3$ point.

FIG. 8 is a graph showing an effect of boron on the $Ar_3$ point of a titanium-added extra-low carbon steel containing 1.3% of copper. More particularly, of measurement of the $Ar_3$ point FIG. 8 shows the results of the above-described carbon steel which has been heat-treated at 1000° C. for 10 min and then allowed to cool at a cooling rate corresponding to that in the step of hot rolling, i.e., at a cooling rate of 30° C./sec.

When the amount of addition of boron is less than 0.0010%, the $Ar_3$ point is rapidly lowered. On the other hand, when boron is added in an amount exceeding 0.0010%, the $Ar_3$ point is mildly lowered.

When boron is added in an amount of 0.0001%, the absolute value of the lowering in the $Ar_3$ point is small. Therefore, the lower limit of the addition of boron is 0.0001%. On the other hand, the addition of boron in an amount exceeding 0.0030% is disadvantageous from the viewpoint of cost. The addition of boron in the above-described amount range is preferred also from the viewpoint of improving the resistance to the deep drawing-induced brittleness.

With respect to the above-described addition of either or both of titanium and niobium and addition of nickel and boron, the above-described effect can be attained even when these elements are added alone or in any combination thereof.

The step of hot rolling in the process for manufacturing a steel sheet according to the present invention will now be described. A high-temperature slab directly transferred from a continuous casting machine or a high-temperature slab produced by heating is hot-rolled at a temperature above the $Ar_3$ point and coiled at a temperature of 500° C. or below. When the coiling is conducted at a temperature exceeding 500° C., the precipitation of copper occurs, which not only makes it impossible to manufacture a soft steel sheet but also renders the increment of the strength through heat treatment small. In the present invention, the precipitation of copper is suppressed by controlling the carbon content, so that a major portion of copper can be kept in a state of supersaturated solid solution by coiling the hot-rolled steel sheet at 500° C. or below. When the hot-rolled steel sheet is coiled at a temperature above 500° C., copper is precipitated, which brings about hardening. In view of the above, the upper limit of the coiling temperature should be 500° C. It is well-known that when the temperature is lowered, the precipitation of copper can be more effectively prevented. In order to maintain the whole of copper in a solid solution state, it is most preferred that the coiling temperature is 50° C. or below. When the carbon or manganese content is high as in the case of the conventional steel, the coiling at a low temperature brings about the formation of hard phases, i.e., martensitic phase and bainitic phase, so that there occurs hardening. In order to avoid this phenomenon, the lower limit of the coiling temperature should be provided. On the other hand, in the steel of the present invention, the hardenability is suppressed to a great extent through limitation of the carbon and manganese content, which makes it unnecessary to set the lower limit of the coiling temperature from the viewpoint of metallurgy. When, however, the coiling is conducted at a temperature lower than 100° C., the shape of the coiled steel sheet is poor. This brings about the deterioration of the surface quality. In view of the above, the coiling temperature should preferably be 100 to 350° C.

By contrast, according to the above-described Japanese Patent Publication No. 17049/1982, the coiling temperature is limited to 350° C. or above (450° C. or below). This is because when the coiling temperature is below 350 C., the workability is lowered due to the occurrence of phase transformation (martensitic or bainitic transformation).

As opposed to the above-described prior art, in the present invention, as described above, the carbon content is limited to a very low value, so that no phase transformation occurs even when coiling is conducted at 350° C. or below. Therefore, in the present invention, there occurs no problem with respect to workability. This makes it possible to conduct low-temperature coiling in such a state that the amount of solid solution of copper is larger than that in the case of the above-described patent.

The hot-rolled sheet thus manufactured is heat-treated after forming to enhance its strength. It is very important from the viewpoint of workability that the heat treatment be conducted at a temperature as low as possible and terminated in a short period of time. The present inventors have made a sufficient study on this matter as well and, as a result, enabled the object to be attained by a heat treatment for a short period of time.

For example, the object can be attained by a heat treatment at a temperature of 750° C. or less for a period of time as short as 30 min or less.

The steel sheet of the present invention may be used for such applications as a frame, wheel, reinforcing parts of automobiles, pressure vessel, compressor cover, shaft bush, etc.

The present invention will now be described in more detail with reference to the following Examples.

BRIEF DESCRIPTION OF DRAWINGS

.

BEST MODE FOR CARRYING OUT THE INVENTION

EXAMPLE 1

Steel ingots A to S shown in Table 1 were heated and hot-rolled at a temperature shown in Table 1 and then coiled to manufacture hot-rolled steel sheets having a thickness of 3.0 mm. The mechanical properties of these steel sheets are also shown in Table 1. The mechanical properties in the case where the steel sheets have been heat treated without conducting deformation working are shown in Table 2.

.As shown in Tables 1 and 2, the steel of the present invention exhibits very excellent ductility during working and brings about a remarkable increase in the tensile strength through heat treatment for a very short period of time. The solid-solution strengthening capability of copper is about 4 kgf/mm$^2$ per % copper, and steel A comprising an extra-low carbon steel and 2.11% of copper added thereto has very low strength and very high ductility as hot-rolled and enables an increase by 25 kgf/mm$^2$ or more in the strength through heat treatment at 600° C. for a period of time as short as 10 min. A silicon-added steel C and a phosphorus-added steel D exhibit not only high strength as hot-rolled but also excellent ductility and a large increase in the strength through heat treatment. Steels B, E, F, J, K and L containing either or both of titanium and niobium added thereto exhibit no lowering in the elongation after aging, i.e., are steel sheets having further improved ductility. By contrast, comparative steels G and I each have a high carbon content and are poor in the ductility during working. Since comparative steel H has a low copper content, no increase in the tensile strength intended in the present invention can be attained by heat treatment in a short period of time.

Figure 8:
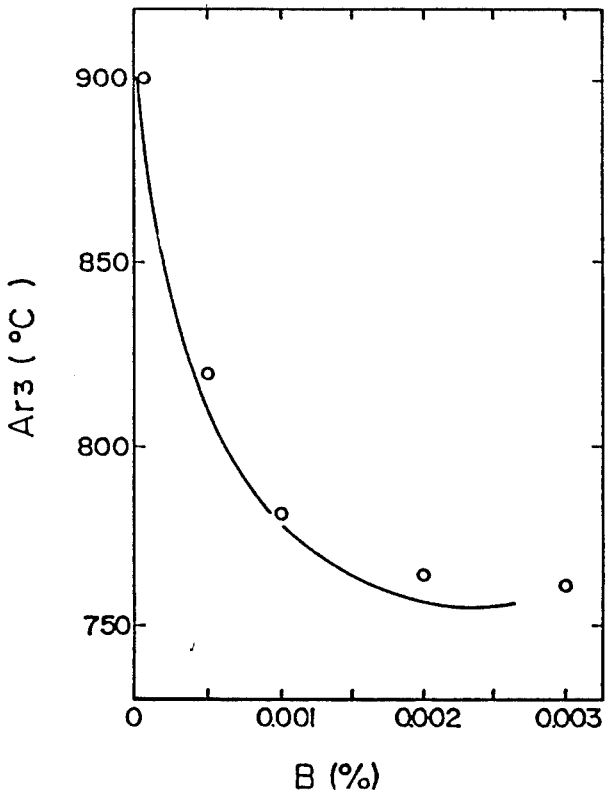
FIG. 8 is a graph showing an effect of the boron content on the $Ar_3$ point of the steel of the present invention.

All of steels A to F and J to L according to the present invention have such excellent characteristics that they exhibit a large elongation before heat treatment and bring about a remarkable increase in the strength through heat treatment in a short period of time. In order to attain such excellent characteristics, it is necessary that the rolling be terminated in an austenitic single phase region (a temperature above the $Ar_3$ point), that the austenitic phase is transformed into a ferritic phase in the step of cooling after rolling and that the steel sheet as coiled have a ferritic single phase structure. Since the above-described steels of the present invention each have a high $Ar_3$ point, as shown in Table 1, high hot rolling finishing temperature was necessary. However, as described above, lower hot-rolling heating temperature is preferable from the viewpoint of avoiding hot shortness attributed to the addition of copper, which brings about a difficulty accompanying the manufacturing of the steel sheet, i.e., with heating at a low temperature and termination of rolling at a high temperature. In order to solve this problem, boron was added in combination with copper in the case of the steels M to S according to the present invention. According to a new finding of the present inventors that the addition of boron to a copper-containing steel brings about a remarkable lowering in the $Ar_3$ point as shown in FIG. 8, in the steels M to S of the present invention, the hot rolling finishing temperature was remarkably lowered as shown in Table 2. As shown in Tables 1 and 2, as with the steel J of the present invention containing no boron (and- having substantially the same copper content), these steel sheets are excellent in the mechanical properties and the increment of the strength through heat treatment.

TABLE 1

Chemical composition (wt %), conditions for hot rolling and mechanical properties of test materials

| Steel | C | Si | Mn | P | S | Al | N | Ti | Nb | Cu | Ni | B |
|---|---|---|---|---|---|---|---|---|---|---|---|---|
| A | 0.0052 | 0.01 | 0.15 | 0.005 | 0.009 | 0.03 | 0.0018 | — | — | 2.11 | — | — |
| B | 0.0013 | 0.01 | 0.18 | 0.009 | 0.007 | 0.05 | 0.0023 | 0.035 | — | 1.43 | — | — |
| C | 0.0135 | 0.84 | 0.20 | 0.007 | 0.010 | 0.04 | 0.0021 | — | — | 1.68 | — | — |
| D | 0.0064 | 0.01 | 0.25 | 0.078 | 0.008 | 0.02 | 0.0015 | — | — | 1.24 | 0.21 | — |
| E | 0.0046 | 0.64 | 0.25 | 0.079 | 0.015 | 0.07 | 0.0019 | 0.048 | — | 2.06 | 0.43 | — |
| F | 0.0072 | 0.01 | 0.15 | 0.081 | 0.012 | 0.03 | 0.0020 | 0.053 | 0.008 | 1.87 | — | — |
| G | 0.0360 | 0.01 | 0.31 | 0.006 | 0.007 | 0.04 | 0.0023 | — | — | 1.05 | — | — |
| H | 0.0054 | 0.01 | 0.15 | 0.008 | 0.009 | 0.05 | 0.0018 | — | — | 0.68 | — | — |
| I | 0.0730 | 0.01 | 0.22 | 0.009 | 0.016 | 0.06 | 0.0022 | — | — | 1.24 | — | — |
| J | 0.0036 | 0.02 | 0.24 | 0.010 | 0.008 | 0.04 | 0.0024 | — | 0.052 | 1.36 | — | — |
| K | 0.0019 | 0.01 | 0.21 | 0.015 | 0.012 | 0.06 | 0.0027 | — | 0.043 | 1.55 | 0.38 | — |
| L | 0.0062 | 0.02 | 0.22 | 0.011 | 0.008 | 0.07 | 0.0030 | 0.044 | 0.007 | 1.30 | 0.19 | — |
| M | 0.0031 | 0.01 | 0.15 | 0.005 | 0.007 | 0.04 | 0.0025 | — | — | 1.35 | — | 0.0004 |
| N | 0.0024 | 0.01 | 0.11 | 0.007 | 0.005 | 0.05 | 0.0031 | 0.045 | — | 1.34 | — | 0.0006 |
| O | 0.0052 | 0.01 | 0.12 | 0.005 | 0.004 | 0.04 | 0.0024 | — | 0.052 | 1.33 | — | 0.0012 |
| P | 0.0045 | 0.01 | 0.18 | 0.006 | 0.005 | 0.06 | 0.0027 | — | — | 1.34 | 0.35 | 0.0015 |
| Q | 0.0012 | 0.02 | 0.19 | 0.009 | 0.007 | 0.03 | 0.0021 | 0.046 | — | 1.32 | 0.41 | 0.0008 |
| R | 0.0021 | 0.01 | 0.16 | 0.010 | 0.008 | 0.04 | 0.0032 | — | 0.042 | 1.38 | 0.17 | 0.0021 |
| S | 0.0022 | 0.01 | 0.14 | 0.008 | 0.009 | 0.04 | 0.0028 | 0.051 | 0.008 | 1.37 | 0.26 | 0.0023 |

| | Hot rolling conditions | | | Before Aging | | | Elongation | |
|---|---|---|---|---|---|---|---|---|
| Steel | Hot rolling heating temp. (°C.) | Hot rolling finishing temp. (°C.) | Coiling temp. (°C.) | Yield point (kgf/mm$^2$) | Tensile strength (kgf/mm$^2$) | Elongation (%) | after aging (100° C. × 1 hr) (%) | Remarks |
| A | 1050 | 912 | 330 | 28.1 | 39.2 | 43.6 | 42.5 | steel of the present invention |
| B | 1050 | 906 | 340 | 25.4 | 36.7 | 47.2 | 47.1 | steel of the present invention |
| C | 1050 | 897 | 220 | 34.5 | 44.9 | 38.6 | 37.1 | steel of the present invention |
| D | 1250 | 925 | 460 | 30.8 | 42.4 | 40.9 | 39.8 | steel of the |

TABLE 1-continued

| Chemical composition (wt %), conditions for hot rolling and mechanical properties of test materials | | | | | | | | |
|---|---|---|---|---|---|---|---|---|
| | | | | | | | | present invention |
| E | 1250 | 932 | 280 | 35.1 | 49.2 | 36.4 | 36.3 | steel of the present invention |
| F | 1050 | 911 | 300 | 29.9 | 44.4 | 40.1 | 40.1 | steel of the present invention |
| G | 1050 | 907 | 400 | 28.4 | 37.6 | 37.2 | 36.1 | comparative steel |
| H | 1050 | 908 | 400 | 23.9 | 34.2 | 47.5 | 47.3 | comparative steel |
| I | 1050 | 914 | 550 | 56.5 | 63.8 | 15.7 | 13.9 | comparative steel |
| J | 1050 | 907 | 320 | 25.8 | 36.9 | 46.3 | 46.1 | steel of the present invention |
| K | 1200 | 910 | 350 | 26.3 | 37.8 | 43.1 | 43.2 | steel of the present invention |
| L | 1100 | 908 | 400 | 26.1 | 37.2 | 43.2 | 43.2 | steel of the present invention |
| M | 1050 | 850 | 310 | 25.2 | 36.6 | 46.5 | 45.1 | steel of the present invention |
| N | 1050 | 840 | 305 | 24.6 | 36.1 | 47.2 | 47.1 | steel of the present invention |
| O | 1100 | 810 | 222 | 24.8 | 36.2 | 46.5 | 46.4 | steel of the present invention |
| P | 1050 | 812 | 211 | 25.4 | 37.1 | 45.4 | 44.3 | steel of the present invention |
| Q | 1050 | 830 | 290 | 24.8 | 36.3 | 47.4 | 47.5 | steel of the present invention |
| R | 1050 | 815 | 230 | 25.1 | 37.3 | 46.2 | 46.3 | steel of the present invention |
| S | 1050 | 821 | 235 | 24.4 | 37.4 | 46.4 | 46.3 | steel of the present invention |

TABLE 2

| | | Conditions for heat treatment and mechanical properties of test materials | | | | |
|---|---|---|---|---|---|---|
| Steel | Conditions for heat treatment | Yield point ($kgf/mm^2$) | Tensile strength ($kgf/mm^2$) | Increment of strength ΔTS ($kgf/mm^2$) | Elongation (%) | Remarks |
| A | 600° C. × 10 min | 53.4 | 63.9 | 28.1 | 28.9 | steel of the present invention |
| B | 600° C. × 10 min | 46.2 | 56.3 | 19.6 | 31.6 | steel of the present invention |
| C | 600° C. × 10 min | 54.9 | 66.6 | 21.7 | 26.4 | steel of the present invention |
| D | 600° C. × 10 min | 46.3 | 55.8 | 13.4 | 32.3 | steel of the present invention |
| E | 600° C. × 1 min | 63.5 | 73.2 | 24.0 | 23.6 | steel of the present invention |
| F | 550° C. × 3 min | 59.5 | 65.8 | 21.4 | 27.1 | steel of the present invention |
| G | 600° C. × 10 min | 39.4 | 47.8 | 10.2 | 23.8 | comparative steel |
| H | 600° C. × 10 min | 22.8 | 32.4 | 0.1 | 45.2 | comparative steel |
| I | 600° C. × 10 min | 57.1 | 63.8 | 0 | 15.8 | comparative steel |
| J | 600° C. × 10 min | 45.1 | 55.1 | 18.2 | 30.2 | steel of the present invention |
| K | 600° C. × 10 min | 47.8 | 58.3 | 20.5 | 28.6 | steel of the present invention |
| L | 550° C. × 10 min | 42.3 | 52.2 | 15.0 | 32.8 | steel of the present invention |
| M | 600° C. × 10 min | 44.5 | 54.8 | 18.2 | 30.1 | steel of the present invention |
| N | 600° C. × 10 min | 43.8 | 54.1 | 18.0 | 31.1 | steel of the present invention |
| O | 600° C. × 10 min | 44.2 | 54.1 | 17.9 | 30.3 | steel of the present invention |
| P | 600° C. × 10 min | 44.7 | 55.2 | 18.1 | 29.3 | steel of the present invention |
| Q | 600° C. × 10 min | 43.8 | 54.0 | 17.7 | 30.2 | steel of the present invention |
| R | 600° C. × 10 min | 44.6 | 55.6 | 18.3 | 28.9 | steel of the present invention |
| S | 600° C. × 10 min | 44.0 | 55.9 | 18.5 | 28.8 | steel of the present invention |

EXAMPLE 2

Steel Nos. 1 and 2 shown in Table 3 were subjected to hot rolling to manufacture hot-rolled steel sheets each having a thickness of 3.0 mm. These steel sheets were each formed into a pressure vessel. Samples were cut out of these pressure vessels. The samples thus cut out had a sheet thickness strain of about 26%. The tensile strength of these samples per se and the tensile strength after heat treatment (corresponding to annealing for removal of stress of the pressure vessel) at 630 C. for 5 min are shown in Table 4. In Table 4, the increment of the strength, ΔTS, was determined by subtracting the tensile strength value of the steel sheet as hot-rolled from the tensile strength value after press forming and heat treatment. Comparative steels softened when heat-treated after working. On the other hand, the steels of the present invention exhibited a further increase in the strength through heat treatment after working.

TABLE 3

Chemical composition (wt %), conditions for hot rolling and mechanical properties of test materials

| Steel | C | Si | Mn | P | S | Al | N | Ti | Cu |
|---|---|---|---|---|---|---|---|---|---|
| 1 | 0.0015 | 0.01 | 0.19 | 0.009 | 0.008 | 0.052 | 0.0021 | 0.036 | 1.44 |
| 2 | 0.12 | 0.02 | 0.41 | 0.011 | 0.008 | 0.095 | 0.0052 | — | — |

| Steel | Hot rolling finishing temp. (°C.) | Hot rolling coiling temp. (°C.) | Yield point (kgf/mm²) | Tensile strength (kgf/mm²) | Elongation (%) | Remarks |
|---|---|---|---|---|---|---|
| 1 | 905 | 390 | 25.3 | 36.8 | 47.1 | steel of the present invention |
| 2 | 865 | 605 | 28.1 | 43.2 | 42.3 | comparative steel |

TABLE 4

| Steel | Tensile strength after press working (kgf/mm²) | Tensile strength after heat treatment | Increment of strength TS (kgf/mm²) |
|---|---|---|---|
| 1 | 55.1 | 58.2 | 21.4 |
| 2 | 58.4 | 40.2 | −3.0 |

EXAMPLE 3

Steel Nos. 3 and 4 respectively having compositions shown in Table 5 were hot-rolled to manufacture hot-rolled steel sheets having a thickness of 2.0 mm. These steel sheets were subjected to pickling, and samples were cut out therefrom and subjected to spot welding. Conditions for spot welding are shown in Table 6. In order to evaluate the spot weld zone, there were conducted measurements of the tension shear strength, cross tension strength, and nugget diameter at each welding current and further measurement of hardness distribution in the cross section of a sample which had been subjected to spot welding with a welding current which will provide a nugget diameter of $5\sqrt{\text{sheet thickness}}$.

TABLE 5

Chemical composition (wt %), conditions for hot rolling and mechanical properties of test materials

| Steel | C | Si | Mn | P | S | Sol.Al | N | Ti | B | Cu | Ni |
|---|---|---|---|---|---|---|---|---|---|---|---|
| 3 | 0.0013 | 0.012 | 0.2 | 0.017 | 0.0036 | 0.0553 | 0.0013 | 0.0451 | 0.0004 | 1.60 | 0.228 |
| 4 | 0.114 | 0.008 | 0.604 | 0.016 | 0.010 | 0.016 | 0.0017 | — | — | — | — |

| Steel | Hot rolling finishing temp. (°C.) | Hot rolling coiling temp. (°C.) | Yield point (kgf/mm²) | Tensile strength (kgf/mm²) | Elongation (%) | Remarks |
|---|---|---|---|---|---|---|
| 3 | 860 | 340 | 35.1 | 44.5 | 39.0 | steel of the present invention |
| 4 | 865 | 610 | 29.7 | 44.4 | 39.9 | comparative steel |

TABLE 6

Conditions for spot welding

| | |
|---|---|
| electrode | Cr—Cu alloy, truncated, electrode tip diameter of 7 mm = $5\sqrt{t}$ |
| initial pressing time: | S.T. = 30 A.C. cycles |
| welding time: | W.T. = 26 A.C. cycles = $(10t + 2) \times 6/5$ |
| holding time: | H.T. = 5 A.C. cycles |
| pressing time: | 600 kgf = 300t |
| welding current: | widely varied from low intensity heat input to such an excessive heat input region as will cause "expulsion". |

Figure 1:
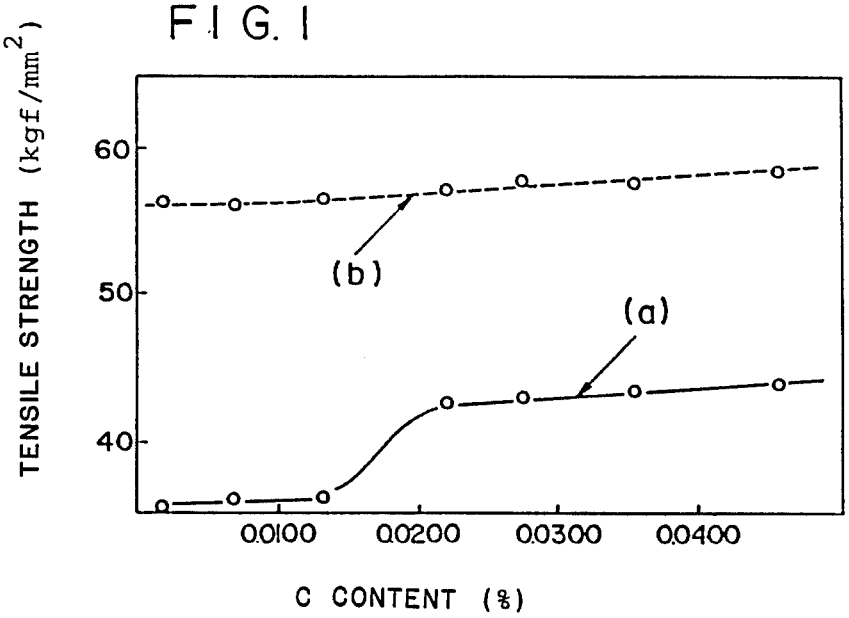
FIG. 1 is a graph showing an effect of the carbon content on the strength of a hot-rolled steel sheet before and after heat treatment for precipitation of copper.
Figure 2:
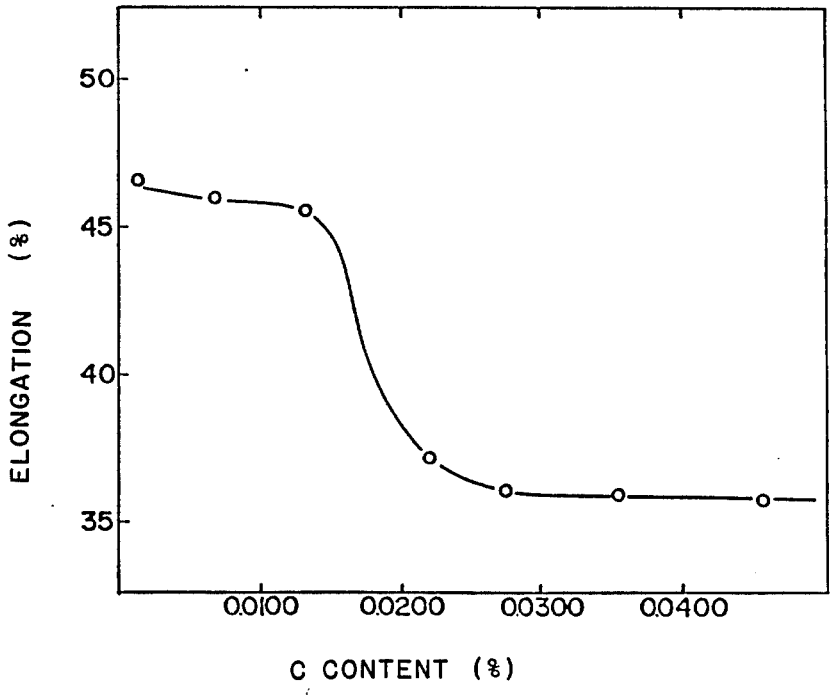
FIG. 2 is a graph showing the effect of the carbon content on the ductility of a hot-rolled steel sheet.
Figure 3:
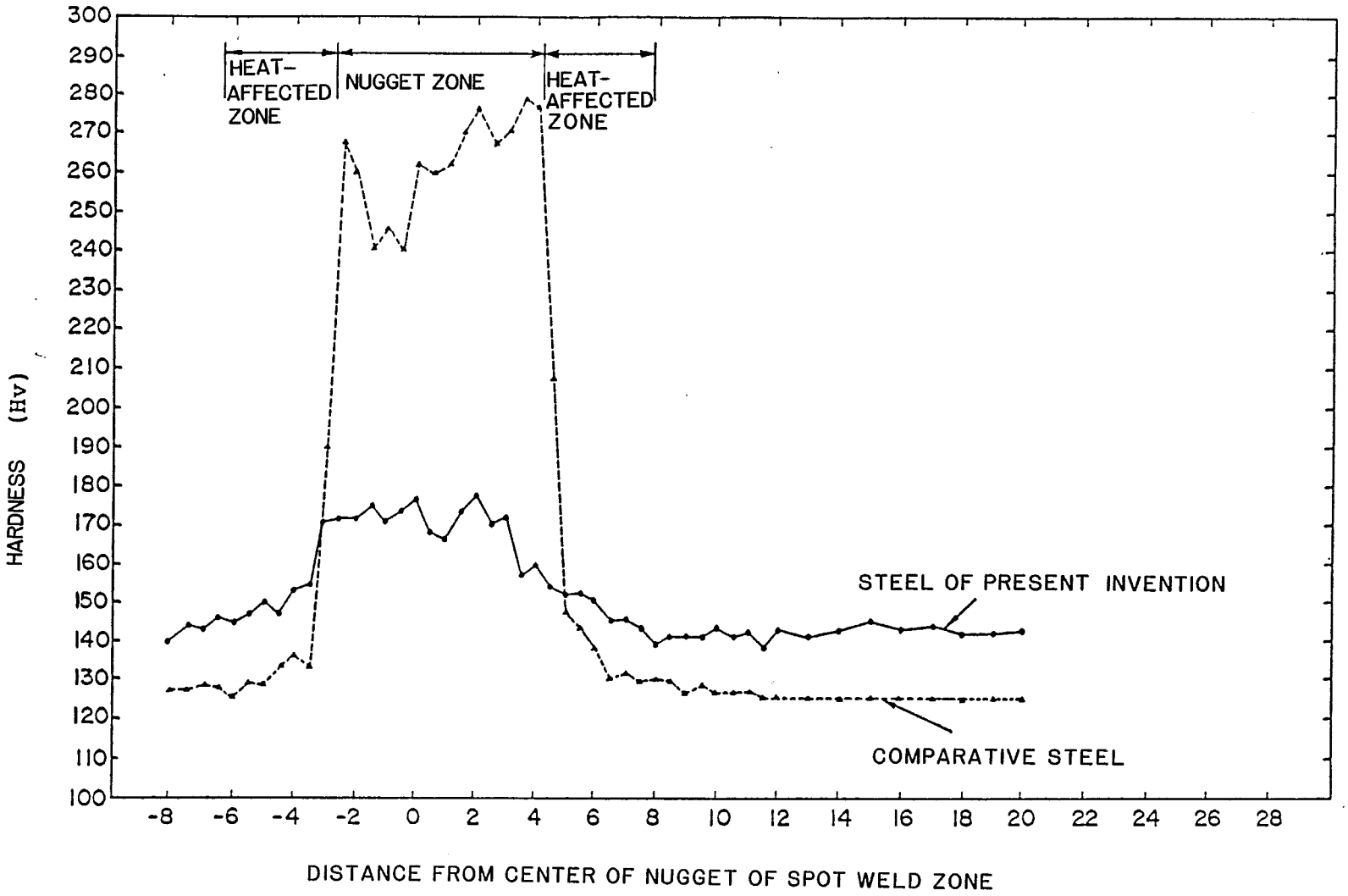
FIG. 3 is a graph showing the hardness distribution in the cross section of a spot weld zone of the steel sheet of the present invention.
Figure 4:
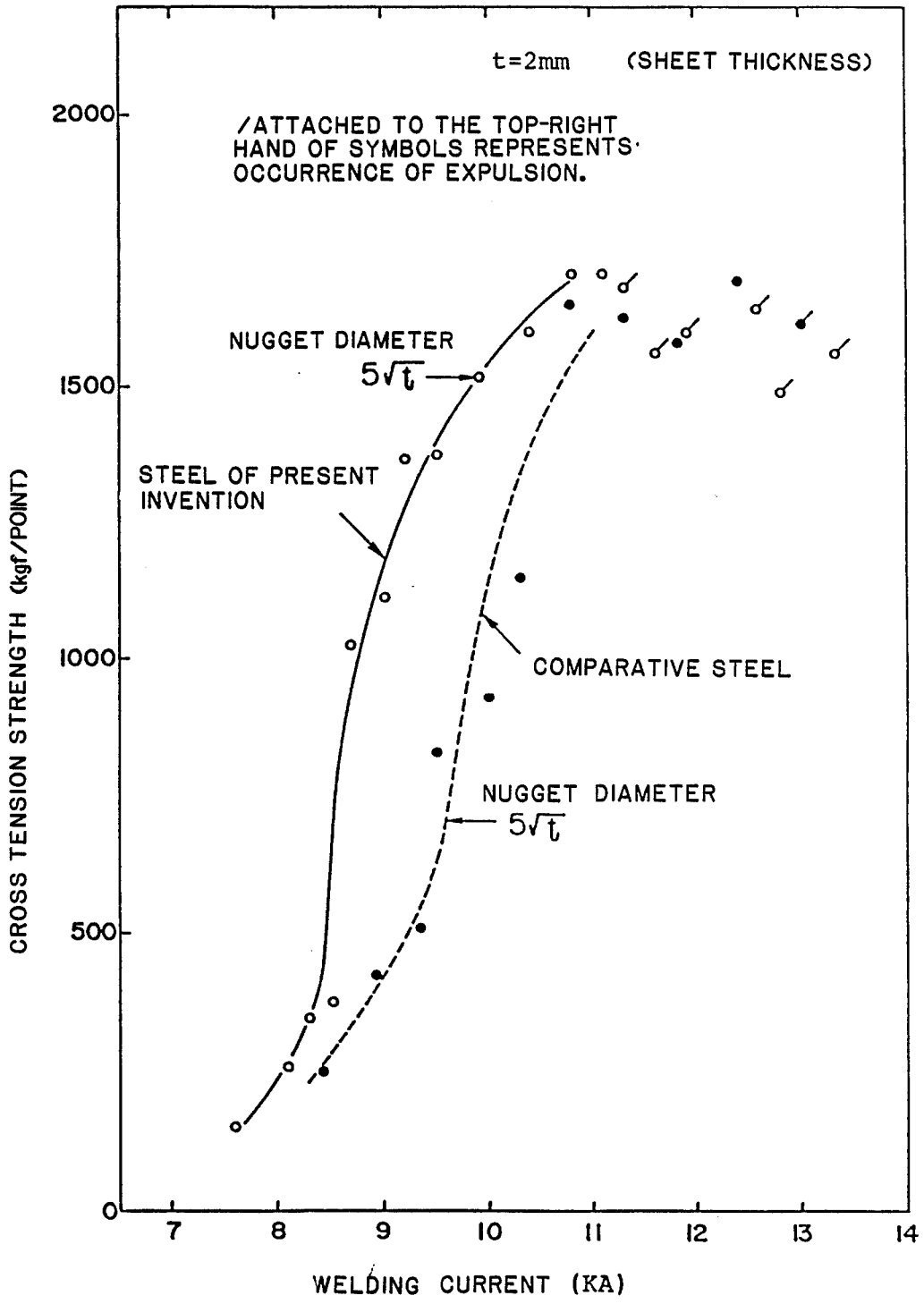
FIG. 4 is a graph showing an effect of a welding current on the cross tension strength of a spot weld zone of the steel sheet of the present invention.
Figure 5:
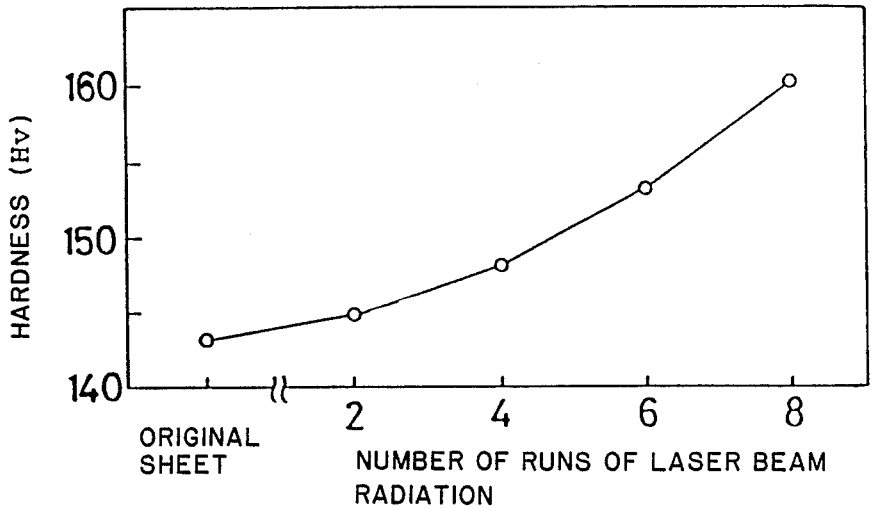
FIG. 5 is a graph showing an effect of the number of runs of laser beam radiation on the change in the hardness of the steel sheet of the present invention.
Figure 6:
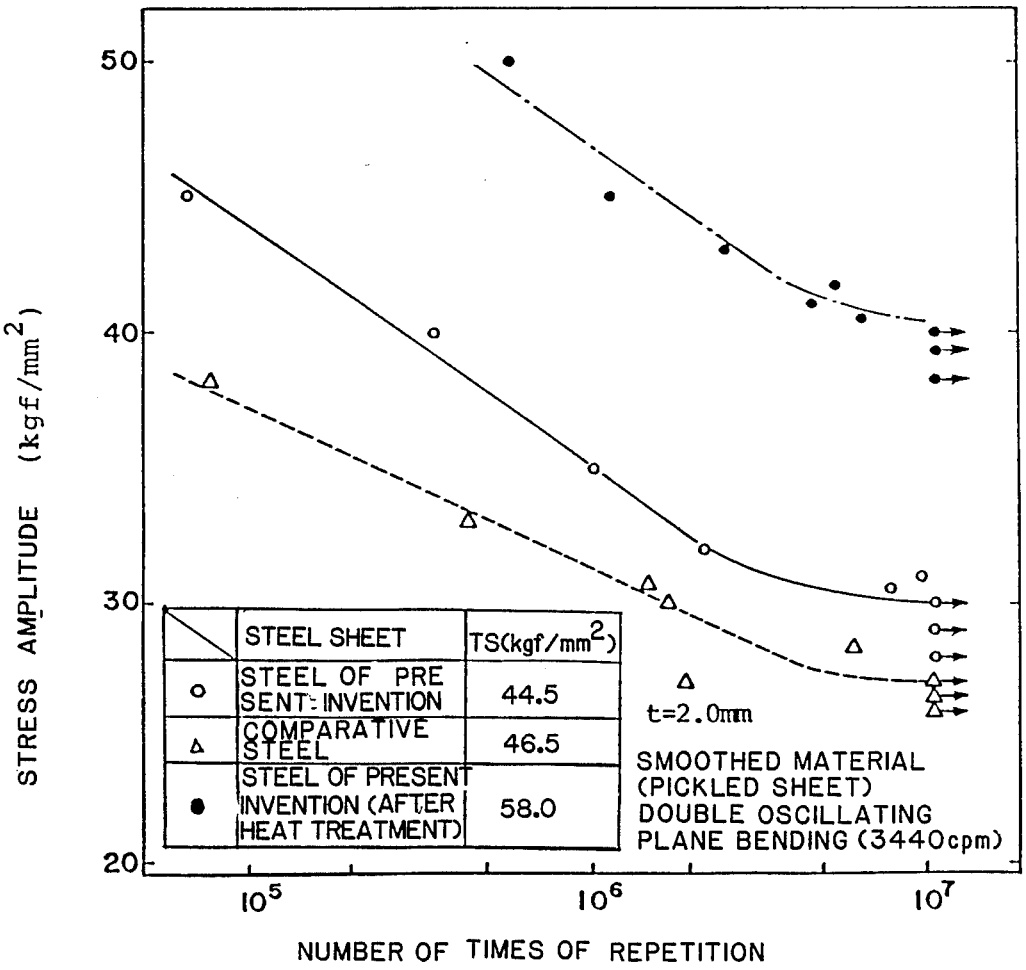
FIG. 6 is a graph showing the fatigue characteristics of the steel sheet of the present invention before and after heat treatment.
Figure 7:
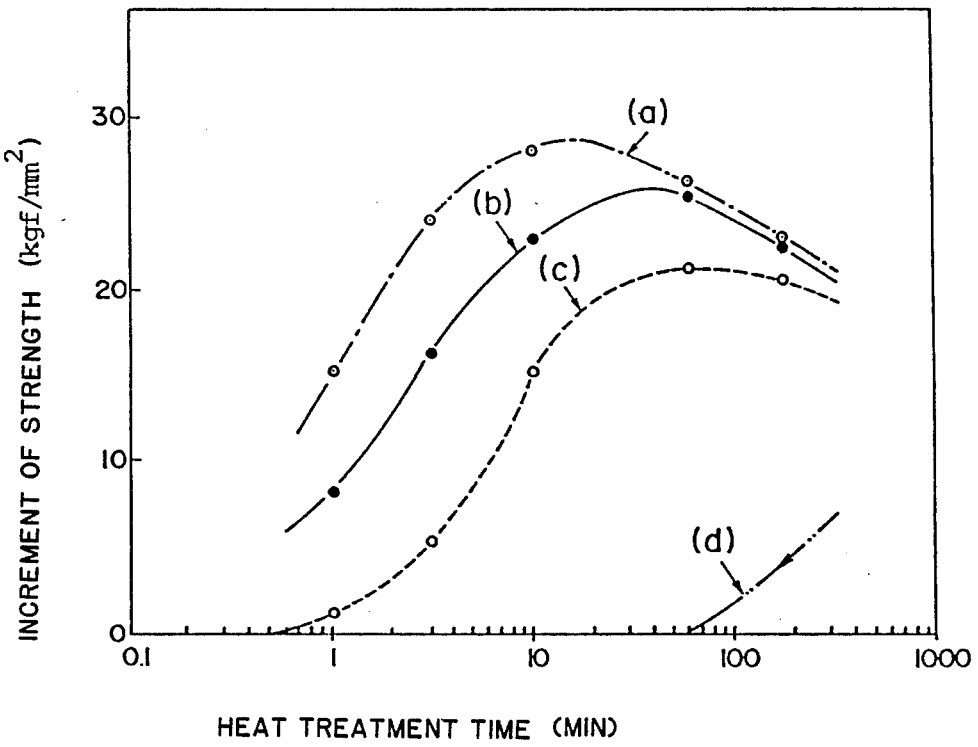
FIG. 7 is a graph showing an effect of the heat treatment time on the increment of the strength of a hot-rolled steel sheet of an extra-low carbon steel, wherein the copper content is used as a parameter.
Figure 9:
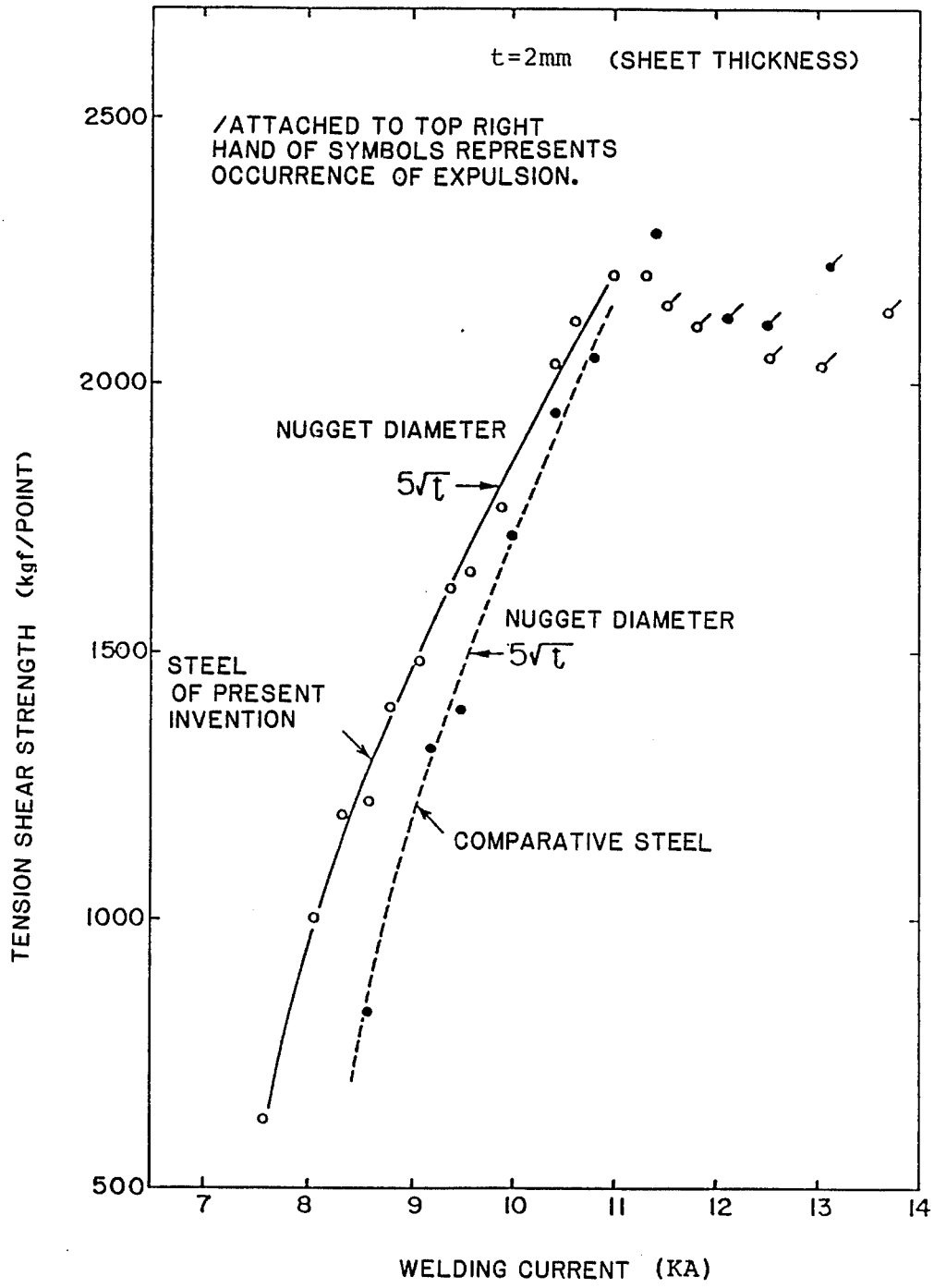
FIG. 9 is a graph showing a welding current on the tension shear strength of a spot weld zone of the steel of the present invention.

FIG. 3 is a graph showing the results of measurement on hardness distribution in the cross section of the weld zone. In the steel of the present invention, an increase in the hardness corresponding to the precipitation of copper was observed in the heat-affected zone. FIG. 4 shows the results of measurement on the cross tension strength at each welding current. The steel of the present invention exhibits high cross tension strength even when the welding current is small. When the cross tension strength is compared at such a current value as will provide a nugget diameter of $5\sqrt{\text{sheet thickness}}$ the cross tension strength of the steel of the present invention is at least twice higher than that of the comparative steel. FIG. 9 shows the results of measurement on the tension shear strength at each welding current. The steel of the present invention exhibits higher shear tensile strength at all welding currents than that of the comparative steel.

INDUSTRIAL APPLICABILITY

The present invention provides a novel hot-rolled steel sheet having very excellent cold workability wherein a high strength necessary for final products can be attained by heat treatment for a short period of time after cold working. Further, the present invention provides a novel process which enables the manufacture of a hot-rolled steel sheet of the kind as described above through simple means such as regulation of composition and control of coiling temperature of the hot-rolled steel sheet. Therefore, the present invention can meet new demands from steel sheet users, which renders the present invention very advantageous from the industrial viewpoint.

We claim:

1. A heat-treatment hardenable hot-rolled steel sheet having remarkably excellent cold workability comprising 0.0005 to 0.015% of carbon, 0.05 to 0.5% of manganese, 0.001 to 0.030% of sulfur, 1.0 to 2.2% of copper, 0.100% or less of phosphorus, 1.0% or less of silicon, 0.0050% or less of nitrogen, and 0.002 to 0.10% of sol. aluminum with the balance being iron and unavoidable elements and substantially comprising a ferritic single phase structure free from occurrence of pearlite.

2. A heat- treatment hardenable hot-rolled steel sheet having remarkably excellent cold workability comprising 0.0005 to 0.015% of carbon, 0.05 to 0.5% of manganese, 0.001 to 0.030% of sulfur, 1.0 to 2.2% of copper, 0.100% or less of phosphorus, 1.0% or less of silicon, 0.0050% or less of nitrogen, 0.002 to 0.10% of sol. aluminum, and either or both of titanium and niobium in respective amounts of 0.01 to 0.2% and 0.005 to 0.2% with the balance being iron and unavoidable elements and substantially comprising a ferritic single phase structure free from occurrence of pearlite.

3. A heat- treatment hardenable hot-rolled steel sheet having remarkably excellent cold workability comprising 0.0005 to 0.015% of carbon, 0.05 to 0.5% of manganese, 0.001 to 0.030% of sulfur, 1.0 to 2.2% of copper, 0.100% or less of phosphorus, 1.0% or less of silicon, 0.15 to 0.45% of nickel, 0.0050% or less of nitrogen, and 0.002 to 0.10% of sol. aluminum with the balance being iron and unavoidable elements and substantially comprising a ferritic single phase structure free from occurrence of pearlite.

4. A heat- treatment hardenable hot-rolled steel sheet having remarkably excellent cold workability comprising 0.0005 to 0.015% of carbon, 0.05 to 0.5% of manganese, 0.001 to 0.030% of sulfur, 1.0 to 2.2% of copper, 0.100% or less of phosphorus, 1.0% or less of silicon, 0.0050% or less of nitrogen, 0.002 to 0.10% of sol. aluminum, and 0.0001 to 0.0030% of boron with the balance being iron and unavoidable elements and substantially comprising a ferritic single phase structure free from occurrence of pearlite.

5. A heat-treatment strengthened type hot-rolled steel sheet having remarkably excellent cold workability comprising 0.0005 to 0.015% of carbon, 0.05 to 0.5% of manganese, 0.001 to 0.030% of sulfur, 1.0 to 2.2% of copper, 0.100% or less of phosphorus, 1.0% or less of silicon, 0.15 to 0.45% of nickel, 0.0050% or less of nitrogen, 0.002 to 0.10% of sol. aluminum, and either or both of titanium and niobium in respective amounts of 0.01 to 0.2% and 0.005 to 0.2% with the balance being iron and unavoidable elements and substantially comprising a ferritic single phase structure free from occurrence of pearlite.

6. A heat- treatment hardenable hot-rolled steel sheet having remarkably excellent cold workability comprising 0.0005 to 0.015% of carbon, 0.05 to 0.5% of manganese, 0.001 to 0.030% of sulfur, 1.0 to 2.2% of copper, 0.100% or less of phosphorus, 1.0% or less of silicon, 0.15,to 0.45% of nickel, 0.0050% or less of nitrogen, 0.002 to 0.10% of sol. aluminum, and 0.0001 to 0.0030% of boron with the balance being iron and unavoidable elements and substantially comprising a ferritic single phase structure free from occurrence of pearlite.

7. A heat- treatment hardenable hot-rolled steel sheet having remarkably excellent cold workability comprising 0.0005 to 0.015% of carbon, 0.05 to 0.5% of manganese, 0.001 to 0.030% of sulfur, 1.0 to 2.2% of copper, 0.100% or less of phosphorus, 1.0% or less of silicon, 0.0050% or less of nitrogen, 0.002 to 0.10% of sol. aluminum, 0.0001 to 0.0030% of boron and either or both of titanium and niobium in respective amounts of 0.01 to 0.2% and 0.005 to 0.2% with the balance being iron and unavoidable elements and substantially comprising a ferritic single phase structure free from occurrence of pearlite.

8. A heat-treatment hardenable hot-rolled steel sheet having remarkably excellent cold workability comprising 0.0005 to 0.015% of carbon, 0.05 to 0.5% of manganese, 0.001 to 0.030% of sulfur, 1.0 to 2.2% of copper, 0.100% or less of phosphorus, 1.0% or less of silicon, 0.15 to 0.45% of nickel, 0.0050% or less of nitrogen, 0.002 to 0.10% of sol. aluminum, 0.0001 to 0.0030% of boron and either or both of titanium and niobium in respective amounts of 0.01 to 0.2% and 0.005 to 0.2% with the balance being iron and unavoidable elements and substantially comprising a ferritic single phase structure free from occurrence of pearlite.

9. A process for manufacturing a heat-treatment hardenable hot-rolled steel sheet having remarkably excellent cold workability which comprises hot-rolling a steel composed of 0.0005 to 0.015% of carbon, 0.05 to 0.5% of manganese, 0.001 to 0.030% of sulfur, 1.0 to 2.2% of copper, 0.100% or less of phosphorus, 1.0% or less of silicon, 0.0050% or less of nitrogen, and 0.002 to 0.10% of sol aluminum with the balance being iron and unavoidable elements at a temperature above the $Ar_3$ point and coiling the resulting hot-rolled steel strip at a temperature of 300° C. or below 10. A process for manufacturing a heat-treatment hardenable hot-rolled steel sheet having remarkably excellent cold workability which comprises hot-rolling a steel composed of 0.0005 to 0.015% of carbon, 0.05 to 0.5% of manganese, 0.001 to 0.030% of sulfur, 1.0 to 2.2% of copper, 0.100% or less of phosphorus, 1.0% or less of silicon, 0.0050% or less of nitrogen, 0.002 to 0.10% of sol. aluminum, and either or both of titanium and niobium in respective amounts of 0.01 to 0.2% and 0.005 t 0.2% with the balance being iron and unavoidable elements at a temperature above the $Ar_3$ point and coiling the resulting hot-rolled steel strip at a temperature of 500° C. or below.

11. A process for manufacturing a heat-treatment hardenable hot-rolled steel sheet having remarkably excellent cold workability which comprises hot-rolling a steel composed of 0.0005 to 0.015% of carbon, 0.05 to 0.5% of manganese, 0.001 to 0.030% of sulfur, 1.0 to 2.2% of copper, 0.100% or less of phosphorus, 1.0% or less of silicon, 0.15 to 0.45% of nickel, 0.0050% or less of nitrogen, and 0.002 to 0.10% of sol. aluminum with the balance being iron and unavoidable elements at a temperature above the $Ar_3$ point and coiling the resulting hot-rolled steel strip at a temperature of 300° C. or below.

12. A process for manufacturing a heat-treatment hardenable hot-rolled steel sheet having remarkably excellent cold workability which comprises hot-rolling a steel composed of 0.0005 to 0.015% of carbon, 0.05 to 0.5% of manganese, 0.001 to 0.030% of sulfur, 1.0 to 2.2% of copper, 0.100% or less of phosphorus, 1.0% or less of silicon, 0.0050% or less of nitrogen, 0.002 to 0.10% of sol. aluminum, and 0.0001 to 0.0030% of boron with the balance being iron and unavoidable elements at a temperature above the $Ar_3$ point and coiling the resulting hot-rolled steel strip at a temperature of 350° C. or below.

13. A process for manufacturing a heat-treatment hardenable hot-rolled steel sheet having remarkably excellent cold workability which comprises hot-rolling a steel composed of 0.0005 to 0.015% of carbon, 0.05 to 0.5% of manganese, 0.001 to 0.030% of sulfur, 1.0 to 2.2% of copper, 0.100% or less of phosphorus, 1.0% or less of silicon, 0.15 to 0.45% of nickel, 0.0050% or less of nitrogen, 0.002 to 0.10% of sol. aluminum, and either or both of titanium and niobium in respective amounts of 0.01 to 0.2% and 0.005 to 0.2% with the balance being iron and unavoidable elements at a temperature above the $Ar_3$ point and coiling the resulting hot-rolled steel strip at a temperature of 350° C. or below.

14. A process for manufacturing a heat-treatment hardenable hot-rolled steel sheet having remarkably excellent cold workability which comprises hot-rolling a steel composed of 0.0005 to 0.015% of carbon, 0.05 to 0.5% of manganese, 0.001 to 0.030% of sulfur, 1.0 to 2.2% of copper, 0.100% or less of phosphorus, 1.0% or less of silicon, 0.15 to 0.45% of nickel, 0.0050% or less of nitrogen, 0.002 to 0.10% of sol. aluminum, and 0.0001 to 0.0030% of boron with the balance being iron and unavoidable elements at a temperature above the $Ar_3$ point and coiling the resulting hot-rolled steel strip at a temperature of 350° C. or below.

15. A process for manufacturing a heat-treatment hardenable hot-rolled steel sheet having remarkably excellent cold workability which comprises hot-rolling a steel composed of 0.0005 to 0.015% of carbon, 0.05 to 0.5% of manganese, 0.001 to 0.030% of sulfur, 1.0 to 2.2% of copper, 0.100% or less of phosphorus, 1.0% or less of silicon, 0.0050% or less of nitrogen, 0.002 to 0.10% of sol. aluminum, 0.0001 to 0.0030% of boron, and either or both of titanium and niobium in respective amounts of 0.01 to 0.2% and 0.005 to 0.2% with the balance being iron and unavoidable elements at a temperature above the $Ar_3$ point and coiling the resulting hot-rolled steel strip at a temperature of 350° C. or below.

16. A process for manufacturing a heat-treatment hardenable hot-rolled steel sheet having remarkably excellent cold workability which comprises hot-rolling a steel composed of 0.0005 to 0.015% of carbon, 0.05 to 0.5% of manganese, 0.001 to 0.030% of sulfur, 1.0 to 2.2% of copper, 0.100% or less of phosphorus, 1.0% or less of silicon, 0.15 to 0.45% of nickel, 0.0050% or less of nitrogen, 0.002 to 0.10% of sol. aluminum, 0.0001 to 0.0030% of boron and either or both of titanium and niobium in respective amounts of 0.01 to 0.2% and 0.005 to 0.2% with the balance being, iron and unavoidable elements at a temperature above the $Ar_3$ point and coiling the resulting hot-rolled steel strip at a temperature of 350° C. or below.

17. A process for manufacturing a heat-treatment hardenable hot-rolled steel sheet having remarkably excellent cold workability according to any one of claims 9 to 16, wherein said hot-rolled steel strip is coiled at a temperature of 100°to 350° C.

18. A steel according to any one of claims 1 to 8 having a carbon content of 0.0005 to 0.008%.

19. A process according to any one of claims 9 to 16 wherein said steel has a carbon content of 0.0005 to 0.008%.

* * * * *